United States Patent [19]

Humphries

[11] 4,194,676

[45] Mar. 25, 1980

[54] LEAKPROOF CONTAINER

[75] Inventor: Richard L. Humphries, Sunnyvale, Calif.

[73] Assignee: Kliklok Corporation, Greenwich, Conn.

[21] Appl. No.: 966,376

[22] Filed: Dec. 4, 1978

[51] Int. Cl.[2] ..... B65D 5/08; B65D 3/04

[52] U.S. Cl. ..... 229/16 A; 229/21

[58] Field of Search ..... 229/21, 16 A, 1.5 B

[56] References Cited

U.S. PATENT DOCUMENTS

| | | | |
|---|---|---|---|
| 1,478,838 | 12/1923 | Reifsnyder | 229/16 A UX |
| 1,514,034 | 11/1924 | Carr | 229/16 A UX |
| 1,690,586 | 11/1928 | Main | 229/16 A UX |
| 1,738,782 | 12/1929 | Main | 229/16 A UX |
| 2,240,599 | 5/1941 | Amberg | 229/21 X |
| 2,281,707 | 5/1942 | Mott | 229/16 A UX |
| 2,323,287 | 7/1943 | Amberg | 229/16 A X |
| 3,381,877 | 5/1968 | Armeson | 229/21 |
| 4,020,988 | 5/1977 | Kipp | 229/21 X |
| 4,102,484 | 7/1978 | Kipp | 229/21 X |

FOREIGN PATENT DOCUMENTS

| | | | |
|---|---|---|---|
| 129811 | 11/1948 | Australia | 229/16 A |
| 586070 | 3/1947 | United Kingdom | 229/16 A |

*Primary Examiner*—Davis T. Moorhead

*Attorney, Agent, or Firm*—Lowe, King, Price & Becker

[57] ABSTRACT

A heat-sealable leakproof container formed from a cut and scored blank of paperboard incorporates foldable gusset panel structural configuration which obviates leakage from the container and enhances its strength and rigidity. The container includes a pair of side wall panels adapted to be secured in an overlapping relationship which are foldably attached at front and rear edges of a bottom wall panel. A pair of double gusset sections are foldably secured at opposite sides of the bottom wall panel and also to the side wall panels. Each gusset section comprises a first triangular panel foldably secured to the bottom wall panel with second and third triangular panels foldably secured between the first triangular panel and the respective side wall panels. The second and third triangular panels are adapted to overlap and the fold line in between nest together when the gusset section is folded to provide a strong leakproof joint.

3 Claims, 8 Drawing Figures

Fig. 1
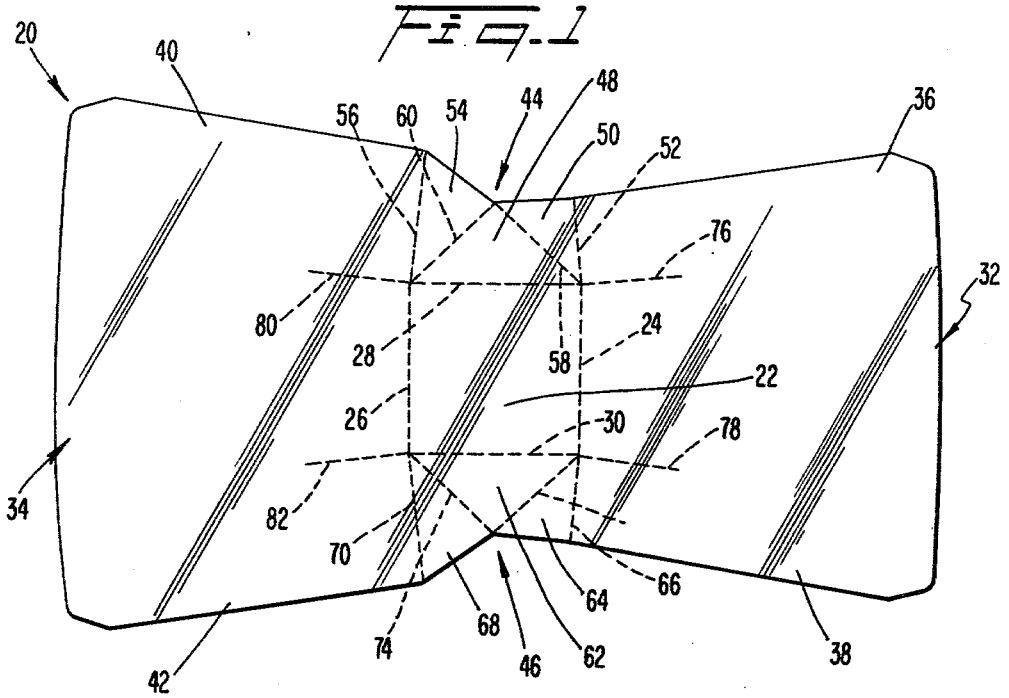
Fig. 3
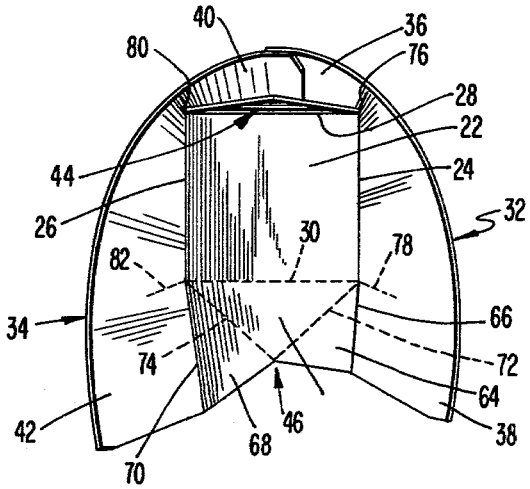
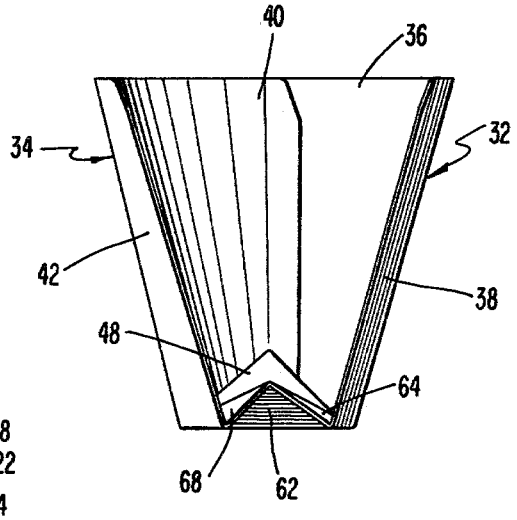
Fig. 2

Fig. 4
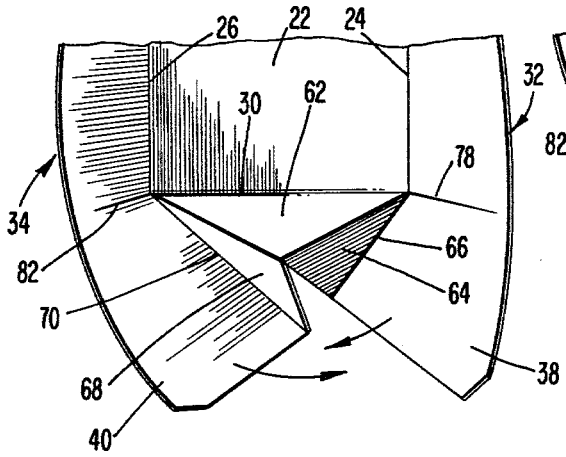
Fig. 5
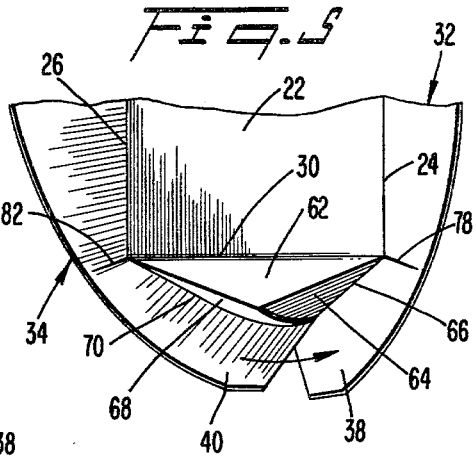
Fig. 6
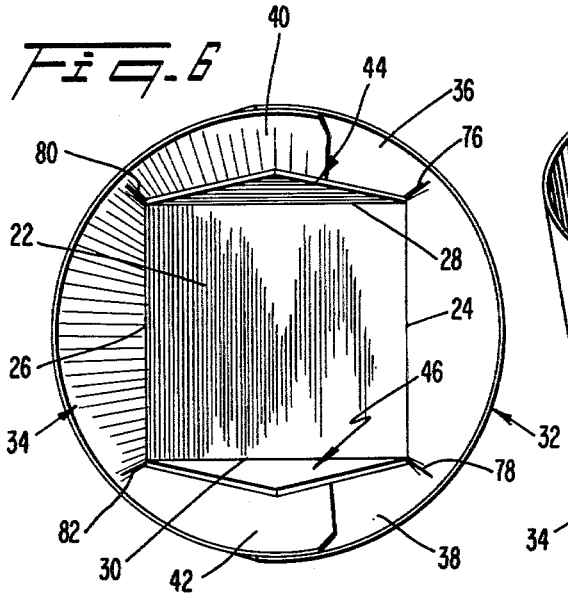
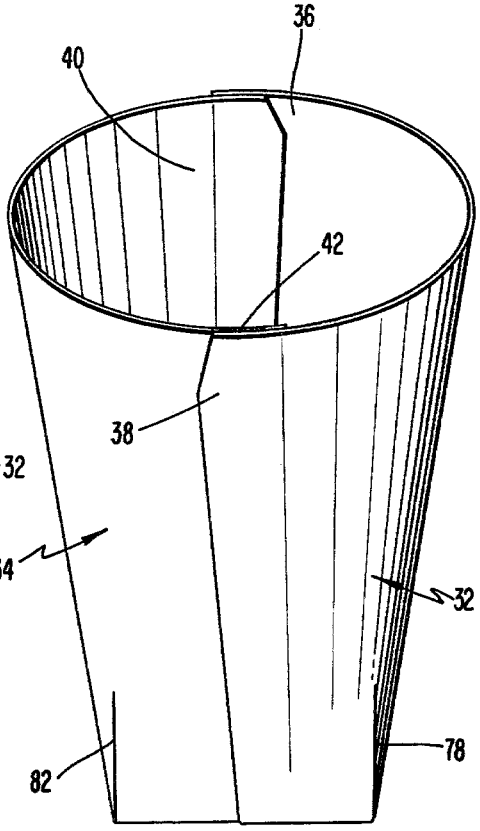
Fig. 8
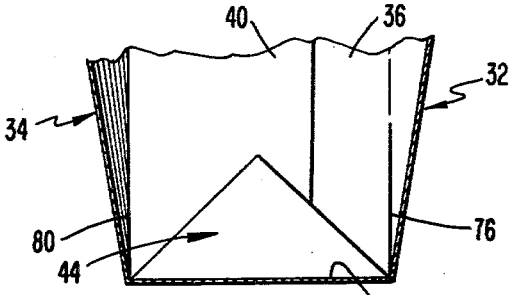
Fig. 7

LEAKPROOF CONTAINER

TECHNICAL FIELD

The present invention relates to a leakproof paperboard container and, more particularly, to a leakproof container formed from a cut and scored blank of paperboard which incorporates foldable gusset panels which overlap to obviate leakage from the sides and bottom of the container.

BACKGROUND ART

Paperboard cups, cartons and other containers formed from a blank of paperboard are well known in the prior art. Typically, the paperboard blank is precut into desired shape and provided with fold or score lines which facilitate formation of the blank into the desired container shape when it is folded and sealed. The paperboard container must have special structural features to prevent leakage especially at the juncture between its side and bottom walls, when liquid or semi-liquid products are being packaged. One example of a successful carton of this general type is disclosed in the Baker U.S. Pat. No. 3,908,890, issued Sept. 30, 1975, owned by the assignee of the present invention.

To overcome the problem of leakage associated with cup-like paperboard containers, it has been proposed to construct the paperboard carton from a blank including a pair of side wall panels foldably secured to a bottom panel with a pair of foldable gusset sections provided on opposite sides of the bottom wall panel which fold upwardly into engagement with the inner wall of the container. See, for example, U.S. Pat. Nos. 4,020,988 and 4,102,484. Typically, each gusset section comprises a set of three triangular flaps foldably secured together. A first isosceles-shaped flap is foldably attached at its base to one side of the bottom wall panel. A pair of second, identically shaped gusset flaps is connected between the equal sides of the first flap and the respective side wall panels. When the gusset sections are folded to form the container, the free edges of the second gusset flaps tend to align in a vertical, edge-to-edge orientation along the inner side wall of the container. These aligned edges of the gusset flaps are difficult to seal against leakage and often provide pinholes which allow the product to leak from the container.

Other prior art proposals, as exemplified by U.S. Pat. Nos. 2,240,599 and 2,323,287, have required gusset sections with a complicated arrangement of fold lines which necessitate difficult assembly procedures.

Accordingly, it is a primary object of the present invention to provide a cup-like leakproof container formed from a cut and scored blank of paperboard which is uncomplicated in design and convenient to assemble.

Another object of the invention is to provide an improved paperboard container incorporating foldable gusset sections which provide a unique overlapping arrangement of gusset panels when the container is assembled to prevent leakage.

It is also an object of the invention to provide a paperboard blank which is cut and scored in a unique configuration to conveniently form a leakproof container when folded and sealed.

A further object of the invention is to provide a leakproof paperboard container enhanced in strength and rigidity.

DISCLOSURE OF INVENTION

The present invention provides an improved leakproof container formed from a cut and scored blank of paperboard which incorporates a unique arrangement of foldable gusset panels to achieve a leakproof joint at the bottom and sides of the container. The gusset panels are designed to overlap when the paperboard blank is folded to form the container to provide a joint which can be readily sealed to minimize leakage from the container.

In accordance with the invention, the leakproof container comprises a side wall formed from a pair of side wall panels having side edges thereof secured in an overlapping relationship, a bottom wall foldably secured at front and rear edges thereof to bottom edges of the side wall panels along a first pair of fold lines, and a pair of gusset sections foldably secured at opposite side edges of the bottom wall along a second pair of fold lines extending substantially normal to the first pair of fold lines and also foldably secured to the side wall panels along extensions of the first fold lines which project outwardly beyond the side edges of the bottom wall. Each gusset section comprises a first triangular panel foldably secured to the bottom wall along one of the second fold lines at the respective side edge thereof, a second triangular panel foldably secured to one of the side wall panels along the extension of the first fold line therebetween, and a third triangular panel foldably secured to the other side wall panel along the extension of the first fold line therebetween with the second and third triangular panels also being foldably secured to the first triangular panel along convergent fold lines. The third triangular panel has an edge extending along the extension of the first fold line located adjacent to its respective side wall panel greater in length than the corresponding edge of the second triangular panel and overlapping the second triangular panel to prevent leakage therebetween.

When the paperboard blank is folded to form the container shape, the third triangular gusset panel and its respective side wall panel are inserted between the second respective side wall panel are inserted between the second triangular panel and its respective side wall panel. The overlapping triangular gusset panels and side wall panels are heat sealed or otherwise bonded together to provide a leakproof seal at the juncture between the side wall panels and bottom wall panel. In addition, the overlapping configuration of gusset and side wall panels serves to enhance the strength and rigidity of the container and minimize raw edge exposure to the product inside the container.

Preferably, the bottom wall is rectangular in configuration with its corners formed by intersections of the first and second fold lines. Each of the side wall panels includes a pair of corner fold lines extending at least partially up along the side walls from the corners of the bottom wall to allow the side wall panels to be conveniently folded into the desired container shape.

The present invention also contemplates a blank of paperboard which is appropriately cut and scored to form the leakproof container when folded and sealed. The unique overlapping gusset panel arrangement permits a strong, leakproof container to be achieved with a minimal amount of paperboard and maximum sealing efficiency.

BRIEF DESCRIPTION OF DRAWINGS

The accompanying drawings illustrate a preferred embodiment of the invention and, taken with the description, serve to explain the principles of the invention.

FIG. 1 is a plan view of a paperboard blank which is cut and scored to form a leakproof container when folded and sealed;

FIG. 2 is a partially assembled side view of the container;

FIG. 3 is a partially assembled top view of the container;

FIGS. 4 and 5 are top views of the container illustrating the assembly steps to overlap the gusset panels;

FIG. 6 is a top view of the assembled container;

FIG. 7 is a partially cutaway section illustrating the inner wall and gusset section of the container; and FIG. 8 is an overall perspective view of the assembled container.

DETAILED DESCRIPTION OF PREFERRED EMBODIMENT

Referring to FIG. 1, a container blank, generally 20, preferably consisting of heat-sealable-plastic-coated paperboard, includes a bottom wall panel 22 defined by a first pair of substantially parallel fold lines 24 and 26 extending along its front and rear edges and a second pair of fold lines 28 and 30 extending along its side edges. Bottom wall panel 22 is rectangular in configuration with its four corners defined by the intersections of first fold lines 24 and 26 with second fold lines 28 and 30.

Container blank 20 also includes a pair of side wall panels 32 and 34 foldably secured to the front and rear edges of bottom wall panel 22 along fold lines 24 and 26, respectively. Side wall panel 32 has edge portions or flaps 36 and 38 which extend laterally beyond the side edges of bottom panel 22 defined by fold lines 28 and 30. Similarly, side wall panel 34 includes edge portions or flaps 40 and 42 which extend laterally beyond the side edges of bottom panel 22. Preferably, container blank 20 is cut such that the edge portions of side wall panels 32 and 34 taper slightly inwardly toward bottom wall panel 22. The finished container ends up generally as inverted frusto-conical in shape (see FIG. 8) because of this tapered cut; i.e., the flaps 36, 38 and 40, 42 are eventually heat sealed together forming the peripheral upstanding side wall.

Container blank 20 includes a pair of double gusset sections 44 and 46 foldably secured to the side edges of bottom wall panel 22 along second fold lines 28 and 30, respectively. Each gusset section consists of a set of triangular panels which are foldable into an overlapping relationship to provide a leakproof joint at the lower side edges of the container.

Gusset section 44 comprises a first triangular gusset 48, preferably isosceles in shape, having its base foldably secured to one side edge of bottom wall panel 22 along fold line 28. A second gusset panel 50 is foldably secured to edge portion 36 of side wall panel 32 along an extension 52 of fold line 24 which projects outwardly beyond the side edge of bottom panel 22. A third gusset panel 54 is foldably secured to edge portion 40 of side wall panel 34 along an extension 56 of fold line 26 which also projects outwardly beyond the side edge of bottom wall panel 22 defined by fold line 28. Gusset panels 50 and 54 are also foldably secured to isosceles-shaped gusset panel 48 along a pair of convergent fold lines 58 and 60 extending along the equal sides of the isosceles-shaped gusset panel. Preferably, extensions 52 and 56 of fold lines 24 and 26 are oriented in slightly convergent configuration.

Similarly, gusset section 46 comprises an isosceles-shaped gusset panel 62 having its base foldably secured to the opposite side edge of bottom wall panel 22 along fold line 30. A second gusset panel 64 is foldably secured to edge portion 38 of side wall panel 32 along an extension 66 of fold line 24 which projects outwardly beyond the side edge of bottom wall panel 22 defined by fold line 30. A third gusset panel 68 is foldably secured to edge portion 42 of side wall panel 34 along an extension 70 of fold line 26 which also projects outwardly beyond the side edge of bottom wall panel 22 defined by fold line 30. Gusset panels 64 and 68 are foldably secured to isosceles-shaped gusset panel 62 by a pair of convergent fold lines 72 and 74, respectively, which extend along the equal sides of the isosceles-shaped panel. Preferably, extensions 66 and 70 of fold lines 24 and 26 are oriented in a slightly convergent configuration.

To allow the triangular panels of double gusset section 44 to be interfolded into an overlapping and sealing relationship in accordance with the invention, the edge of gusset panel 54 extending along extension 57 of fold line 26 is greater in length than the corresponding edge of gusset panel 50 extending along extension 52 of fold line 24. Similarly, in double gusset section 46 the edge of gusset panel 68 extending along extension 70 of fold line 26 is greater in length than the corresponding edge of gusset panel 64 extending along extension 66 of fold line 24. Consequently, when paperboard blank 20 is folded into its container shape, gusset panel 54 overlaps gusset panel 50, while gusset panel 68 overlaps gusset panel 64 (compare FIGS. 1, 4 and 5). In essence, the gusset structure of panels 48, 54 and 62, 68 tuck into the corresponding gusset structure of panels 48, 50 and panels 62, 64, respectively. It will be realized then that panels 48, 62 are common to interlocking gusset structures that are effective in combination of eliminating edge butting panels and thus avoiding a potential leaking problem between those edges. Also, the outer raw edges along second gusset panels 50, 64 are completely isolated from the inside of the container (see FIGS. 1 and 5), and the gusset sections 44, 46 are firmly pressure sealed against the flaps 36, 40 and 38, 42 of the side wall thereby greatly minimizing the exposure of the gusset edges inside the container. This asymetrical gusset configuration also prevents deleterious alignment of the side edges of the flaps 40, 42 with the side edges of the gusset structures 44, 46. This is important to obviate potential leakage due to wicking along abutting and aligned raw edges, such as found in prior art containers.

In addition, as shown in FIG. 8, edge portions 36 and 40 of side wall panels 32 and 34, respectively, overlap on one side of the container, while edge portions 38 and 42 of the side wall panels overlap on the opposite side of the container.

In the preferred embodiment, semi-peripheral side wall panel 32 includes a pair of corner fold lines 76 and 78, preferably consisting of extensions of fold lines 28 and 30, which project outwardly beyond a fold line 24. Corner fold lines 76 and 78 are oriented in a slightly divergent configuration. Similarly, semi-peripheral side wall panel 34 includes a pair of corner fold lines 80 and 82, preferably formed as extensions of fold lines 28 and 30, projecting outwardly beyond fold line 26. Corner fold lines 80 and 82 are also oriented in a slightly divergent configuration. With paperboard blank 20 folded into its container shape (FIG. 8), fold lines 76, 78, 80 and 82 extend upwardly about ⅓ the height of the container. These fold lines form a gradual transition along the height of the cup from a rectangular base for strength and folding efficiency to a round top for filling efficiency and ease of use.

In the assembly of the container (FIG. 8), paperboard blank 20 is initially folded along fold lines 24 and 26 to raise side wall panels 32 and 34 into vertical orientation. Edge portions 36 and 38 of side wall panel 32 are folded around corner fold lines 76 and 78 to overlap edge portions 40 and 42 of side wall panel 34 which are similarly folded around corner fold lines 80 and 82. Referring to FIG. 4, in folding edge portions 38 and 42 into the overlapping relationship, gusset panel 62 is folded upwardly along fold line 30 while gusset panels 64 and 68 are folded upwardly along fold lines 66 and 70, respectively. As shown in FIG. 5, gusset panel 68 is overlapped on the outside of gusset panel 64 while edge portion 42 of side wall panel 34 is overlapped inside edge portion 38 of side wall panel 32. Similarly, referring to FIGS. 1 and 3, gusset panel 54 is overlapped on the outside of gusset panel 50 while edge portion 40 of side wall panel 34 is overlapped inside edge portion 36 of side wall panel 32.

Referring to FIGS. 6 and 7, when the folding of the container blank is completed, gusset section 44 extends upwardly along the inside of overlapped side edges 36 and 40 while gusset section 46 extends upwardly along the inside of overlapped side edges 38 and 42. Preferably, the heat sealing of the container panels including the overlapping side wall portions 36 and 40 and overlapping side wall portions 38 and 42 is performed by heating the plastic coating and/or the selective application of adhesive and pressure, as is well known in the art. In addition, gusset sections 44 and 46 are similarly heat and pressure sealed to the inside of the overlapping side wall portions. The fold line extensions 56, 70 are tightly nested within the respective fold line extensions 52, 66 with the thermoplastic coating on the adjacent panels flowing between all surfaces. Edge-to-edge abutting gusset seams and alignment of the side seam and the gusset seams and the resulting potential pinhole leakage channel therealong is avoided. As a result, the strong, leakproof container is achieved.

Thus, the invention provides an overlapping gusset panel arrangement which ensures a leakproof joint along each side edge and at the bottom of the container. In addition, the configuration utilizing a rectangular bottom gradually changing into a round top combines strength and rigidity with maximum functionality to the container assembly.

The present invention is not limited to the specific details shown and described, and modifications may be made in the leakproof container without departing from the scope of the invention.

I claim:

1. A leakproof container formed from a cut and scored blank of paperboard, comprising:

a side wall formed from a pair of side wall panels having side edges thereof secured in an overlapping relationship;

a bottom wall foldably secured at front and rear edges thereof to bottom edges of said side wall panels along a first pair of fold lines;

a pair of gusset sections foldably secured at opposite side edges of said bottom wall along a second pair of fold lines extended substantially normal to said first pair of fold lines, said gusset sections being foldably secured to said side wall panels along extensions of said first fold lines projecting outwardly beyond said side edges of said bottom wall;

each gusset section comprising a first triangular panel foldably secured to said bottom wall along one of said second fold lines at the respective side edge thereof, a second triangular panel foldably secured to one of said side wall panels along the extension of the first fold line therebetween, and a third triangular panel foldably secured to the other side wall panel along the extension of the first fold line therebetween, said second and third triangular panels also being foldably secured to said first triangular panel along convergent fold lines; and said third triangular panel having an edge extending along the extension of said first fold line located adjacent to its respective side wall panel greater in length than the corresponding edge of said second triangular panel and overlapping said second triangular panel to prevent leakage therebetween, whereby two adjacent gusset structures including said first gusset panel as a common panel are overlapped and raw edges are in nonaligned orientation with said third triangular panel and its respective side wall panel inserted between said second triangular panel and its respective side wall panel and said overlapping gussets disposed within the interior of said container along said side wall panels to provide a leakproof seal and a relatively smooth and flat exterior for said bottom wall.

2. The leakproof container of claim 1, herein:

said bottom wall is rectangular in configuration with its corners formed by intersections of said first and second fold lines to form a rectangular cross section of said container adjacent the bottom, and said side wall forms a round cross-section adjacent the top with a gradual transition in between.

3. The leakproof container of claim 2, wherein:

each of said side wall panels includes a pair of corner fold lines extending upwardly from said corners of said bottom wall.

* * * * *